US006322859B1

(12) United States Patent
Pluim et al.

(10) Patent No.: US 6,322,859 B1
(45) Date of Patent: Nov. 27, 2001

(54) AESTHETIC ENHANCEMENT OF SUBSTRATES

(75) Inventors: Arthur W. Pluim, Aptos, CA (US); Elise C. Kinkead, Mendota Heights, MN (US)

(73) Assignee: Riverwind, LLC., Watsonville, CA (US)

( * ) Notice: Subject to any disclaimer, the term of this patent is extended or adjusted under 35 U.S.C. 154(b) by 0 days.

(21) Appl. No.: 09/430,772

(22) Filed: Oct. 29, 1999

Related U.S. Application Data

(60) Provisional application No. 60/107,319, filed on Nov. 6, 1998.

(51) Int. Cl.[7] ..... C23C 8/00

(52) U.S. Cl. ..... 427/585; 204/192.14; 204/192.15; 427/250; 427/255.7; 427/276; 427/288; 427/289; 427/294; 427/296; 427/331; 427/404

(58) Field of Search ..... 427/585, 294, 427/296, 250, 255.7, 276, 288, 289, 331, 404; 204/192.14, 192.15

(56) References Cited

U.S. PATENT DOCUMENTS 4,118,523 * 10/1978 Bingham et al. .
5,709,943 * 1/1998 Coleman et al. .

* cited by examiner

*Primary Examiner*—Bernard Pianalto

(57) ABSTRACT

A process is described for producing a decorative material such as a wall covering material by applying a very thin layer of metal to the surface of a textured flexible substrate. The thin metal layer replicates the surface features and texture of the substrate to thereby create interesting visual effects.

17 Claims, 3 Drawing Sheets

(3 of 3 Drawing Sheet(s) Filed in Color)

AESTHETIC ENHANCEMENT OF SUBSTRATES

CROSS-REFERENCE TO RELATED APPLICATIONS

This application claims the benefit of our copending Provisional Application No. 60/107,319, filed Nov. 6, 1998.

FIELD OF THE INVENTION

This invention relates to surface enhancement of substrates. More particular, this invention relates to application of a thin layer of metal to the surface of a variety of substrates.

BACKGROUND OF THE INVENTION

The use of thin layers of metal, gold in particular, dates back to early civilizations such as Egyptian or pre-Columbian America. It was driven by the desire to decorate large surfaces such as images, statuary, or walls, but was limited by the relative scarcity of the metal. Fortunately, its malleabiity allowed the creation of the thin foils that enabled the decoration of those surfaces with gold and its mystical connotations.

The art of gilding, as it was known, continued to evolve in the form of thinner gold foils and eventually into metal alloys that simulated the appearance of gold. Other metal foils became available such as silver, copper, aluminum and various copper alloys. Gilding had begun to move from the realm of the religious, rich and powerful into somewhat more common usage.

However, the use of gilding remained limited by the nature of gilding itself. Typically the metals are in the form of extremely thin (less than 0.001 inch) foils which are very fragile. They are limited in size, 3"×3" for gold, 5"×5" for other metals. Because of their extreme thinness and fragility, handling the foils requires specialized techniques and much practice to apply the material to a surface. Large surfaces, such a walls or ceilings, are only occasionally gilded because of the high cost of materials and skilled labor required to apply the metal coatings one piece at a time. There is also a limitation on the types of metals available as foils. For example, titanium, iron, stainless steel, nickel, molybdenum, zinc, etc. do not have the physical characteristics to be made into gilding foils.

The desire for the look of metal has remained constant. There are a variety of methods for applying metals to surfaces in lieu of gilding foils. They have typically been in the form of pigmented coatings made up of metal flakes (powder mixed with organic binder) which are then coated onto a flexible substrate. Other methods used involve foils created by conventional metal rolling techniques or the metallization of polymer film. These are then laminated, using solution-based or hot-melt adhesives, to some kind of carrier web which can be subsequently converted into wall coverings, wrapping paper, ribbon or other decorative surfaces.

The coatings consisting of metallic pigments are not available for subsequent chemical treatments, called patinas, which provide further aesthetic potential. These chemical treatments are often rendered on gilded surfaces or possibly foil laminates because a true metallic surface is available.

There has not heretofore been provided a simple and effective means for creating decorative surfaces by the application of metal coatings to textured flexible substrates.

SUMMARY OF THE INVENTION

In accordance with the present invention there are provided techniques for preparing decorative surfaces by applying one or more metal coatings to flexible substrates. A "flexible" substrate is defined herein as one which can be folded back on itself (180 degrees) and reversed without sustaining damage to the physical properties of the material. There may be alteration in visual appearance. A decorative surface is defined as a surface which has some level of aesthetic appeal, usually visual in nature. This visual appeal could be a naturally occurring phenomenon or somehow randomly created or it may be created by deliberate modification of a surface with textural elements, color from a variety of sources and combinations, light reflecting, refracting elements or combinations of all of the above. These decorative elements are often created on flexible substrates by printing, dying, embossing, weaving laminations, gilding, coating, pigmenting, chemical modification of the surface, thermal processes, brushing, abrading, wrinkling, creasing, folding or any other methods that modify the surface, additively, subtractively, texturally, and/or some visual manner.

As used herein, a "textured" substrate is defined as a substrate having surface features, above and/or below the plane of the surface that are greater than 0.051 mm. The profiles of these surface features, whether parallel or perpendicular to the plane of the surface, can be of any configuration or combination of configurations, angular, curvilinear, irregular, etc. Further, these surface variations can be random in nature or can be in the form of deliberate patterns.

The texture may be typical of the substrate as manufactured as in the case of flocked, woven, or non-woven fabrics which are nominally supplied with surface features of 0.051 mm or greater. Also substrates such as films, papers, laminates, vinyls, plastics and the like which do not normally have such surface features can be caused to have such features (e.g. by embossing, brushing, perforating, crimping, abrading or even the use of additional coatings to create surface features of 0.051 mm or greater).

The substrate used for the metal coatings is typically textured before the metal coating is applied. However, the texture may also be created after the metal coating has been applied.

The techniques of the present invention are applicable to large surface area substrates in an economical manner. Consequently, the coated and treated substrates are useful for covering large surfaces (e.g. walls) without a multiplicity of seams or non-uniformities inherent with current gilding practices.

Other features and advantages of the processes and techniques of this invention will be apparent from the following detailed description.

BRIEF DESCIPTION OF THE DRAWINGS

The file of this patent contains at least one drawing executed in color. Copies of this patent with color drawing (s) will be provided by the Patent and Trademark Office upon request and payment of the necessary fee.

The invention is described in more detail hereafter with reference to the accompanying drawings, wherein like reference characters refer to the same parts throughout the several views and in which.

DETAILED DESCRIPTION OF THE INVENTION

Figure 1:
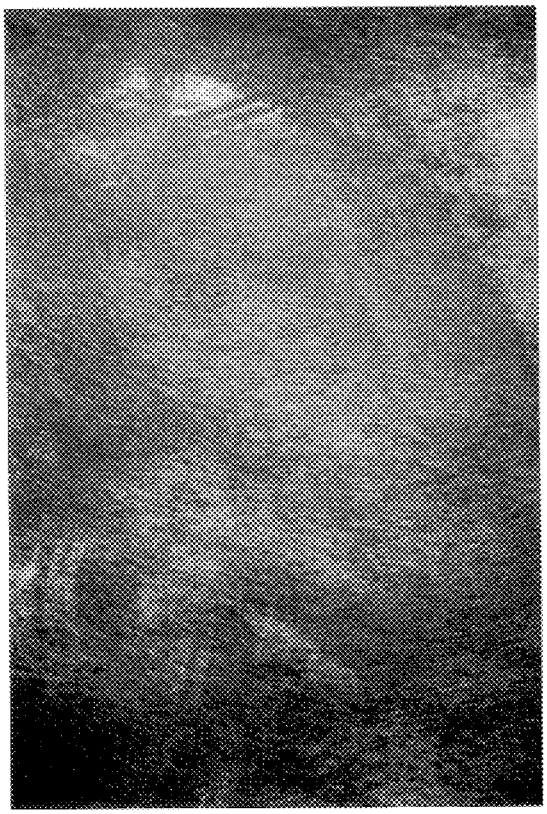
FIG. 1 shows a copper-coated non-woven substrate. The metal has been brushed with sodium sulfide as described in Example VI.
Figure 2:
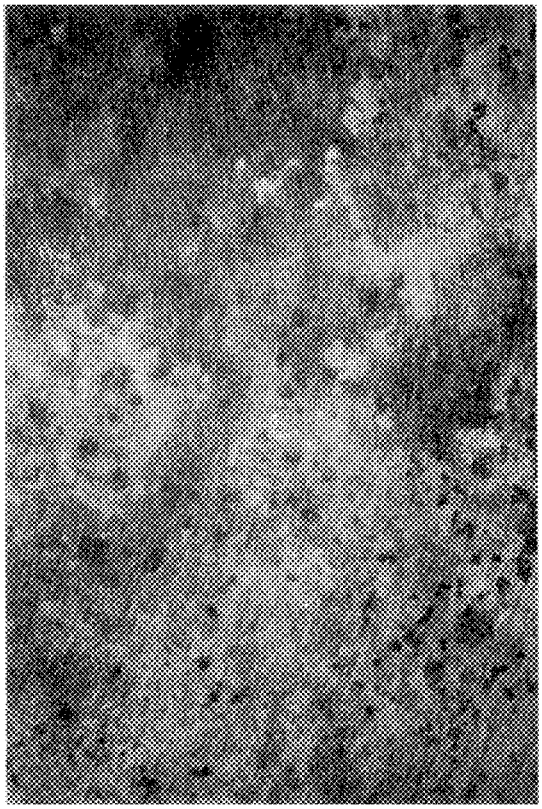
FIG. 2 shows a copper-coated non-woven substrate which was treated with sodium sulfide using other techniques from Example VI.
Figure 3:
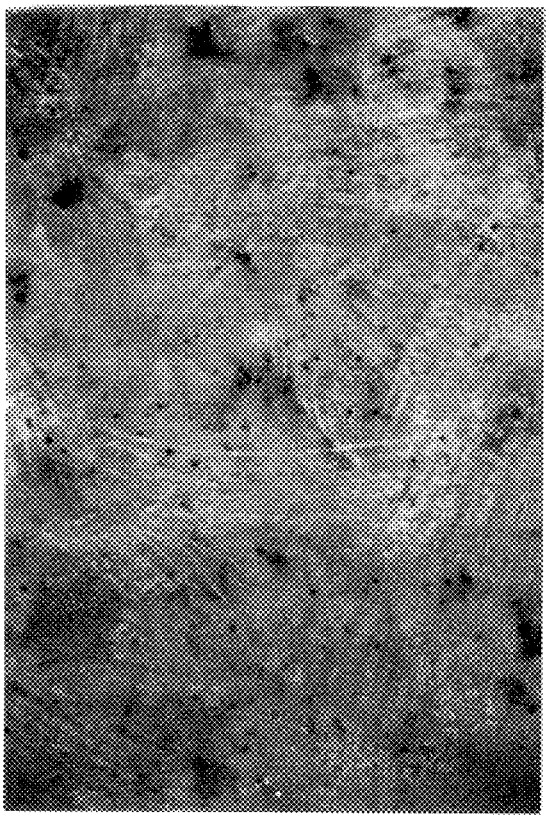
FIG. 3 is illustrative of the product produced in Example II and is a copper-coated non-woven substrate treated with potassium sulfate.
Figure 4:
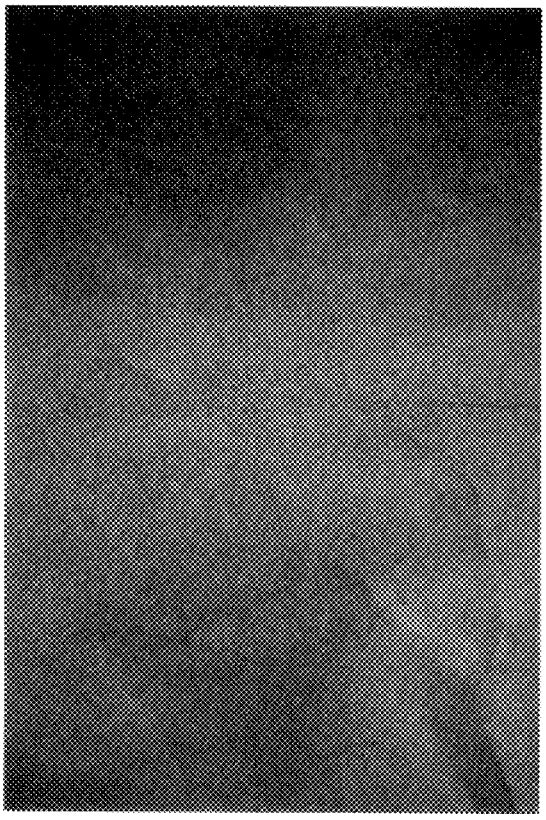
FIG. 4 shows the product produced in Example IV and is an iron-coated non-woven substrate that was allowed to age unprotected.
Figure 5:
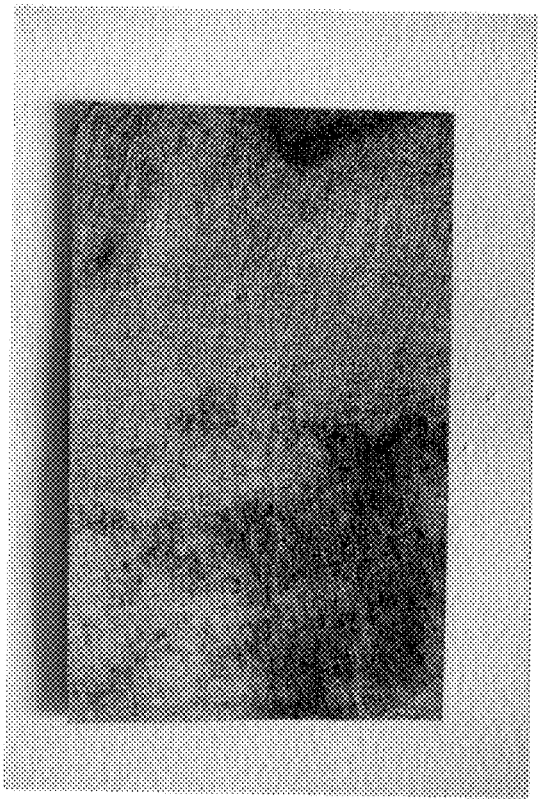
FIG. 5 shows the product produced in Example III.
Figure 6:
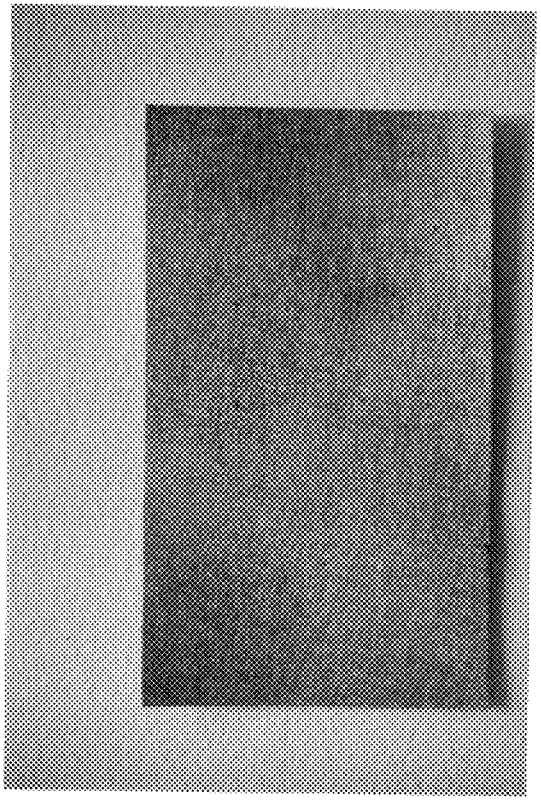
FIG. 6 shows a titanium-coated non-woven substrate. In this and all examples described herein the fibrous texture of the substrate creates the aesthetic combination of the metal and the fabric.

An important aspect of this invention is that metal is applied to the surface of a flexible substrate at virtually the molecular level, so precise control of coating thickness is possible. This precise control of metal coating thickness provides further advantages, both aesthetic and economic. Aesthetically, because of the possibility of extremely thin metallic layers (2500 Angstroms or less), transparency, interference colors and other optical effects can be obtained. Again because of the precise control of metal thickness, coatings can be applied to the level desired for optical effects without having to provide for secondary handling. Hand applied gilding foils are 25 times thicker for mechanical reasons than are required for opaqueness. The economy thus provided by the present invention is clear, especially with precious metals. This thinness of coating also replicates, as it metalizes, finely textured surfaces or surface patterns which is a particular means of providing decorative elements.

The coating methods employed in this invention for creating these decorative surfaces are generally described as metal vapor deposition. These processes, although in a variety of forms, generally involve the application of energy to solid metal target or source such that it creates a metal vapor. The metal vapor is then caused to condense by juxtaposition, onto in this instance, a cooler flexible substrate which is transported past the source of the metal vapor. The thickness of the metal coating is regulated by varying the amount of metal vapor present (usually by the amount of energy applied to the metal) and the speed at which the substrate is transported past the source.

The two most common types of metal deposition processes, each with a variety of configurations, are evaporative coating and sputtering. Evaporative coating literally involves the boiling of a metal under vacuum. Evaporative coatings are limited to metal such as aluminum, copper, gold, silver, etc., metals which can be reasonably melted and have a high enough vapor pressure to provide sufficient quantities of the metal vapor for rapid, economic deposition of the metal. Evaporative coatings are generally quite economical and widely used for applications such as packaging and solar control films involving aluminum. This process tends to be more rapid than sputtering, but of ten the coatings are not as tightly adhered.

The sputtering process typically involves the creation of a plasma which is capable of putting more energy into a metal target. This allows the coating of the more refractory metals such as stainless steel, Inconel(R), titanium, nickel, etc. in addition to the metals coated evaporatively. Because of the higher energy of the process, coatings tend to be more tightly adhered. Either process or their many variations would be capable of providing the desired coatings.

A means of providing yet another aspect of aesthetic capabilities is the ability of the metal vapors during the coating process to react virtually simultaneously with other species such as nitrogen, oxygen, sulfides, etc. to produce a variety of colors and effects. Additionally, these reacted coatings can serve to protect underlying metal layers from atmospheric and handling corrosion (copper and silver, especially). The compounds so formed would be variously nitrides, oxides, sulfides, carbides or mixtures thereof.

The processes for applying metal to the substrates are nominally done under vacuum conditions to allow maximum evaporation of the metal, minimize contamination/secondary reactions, protect the substrate and machinery components from oxidation.

This process technology enables the creation of a variety of metal based surface enhancement/decorating materials which overcome the limitations of conventional techniques. Metal can be applied to highly textured substrates which are otherwise not coatable. Multiple layers of metal, applied sequentially, create interference colors and effects. Other in-process reactions provide color, transparency, translucency effects directly on the coated metals. Metals can be coated that can't be applied with existing gilding techniques.

Direct application and adhesion of metal to clean substrates is achieved without adhesives, lamination or surface treatment or preparation. The present invention results in very economical application of metals to the substrates. The techniques of the invention enable creation of surfaces which are not replicatible by painting techniques. Metal-coated surfaces can be subsequently treated with various chemistries to produce other aesthetics. Texturing, printing or pretreating the substrate before or after coating are also possible.

The substrates which may be used in this invention include films, papers, non-wovens, laminates, vinyls, plastics, flocked substrates, polymers (such as polyester, rayon, acetates, or polypropylene), fabric, cloth, textured substrates, fibers, and substrates with various types of surfaces (e.g., calendared, spun bond, brushed, suede, matte, embossed, sized, needle punched, crimped, etc.).

A variety of metals may be used in this invention, including, for example, aluminum, chromium, cobalt, copper, gold, iron, iridium, lithium, manganese, molybdenum, nickel, niobium, scandium, rhodium, silicon, silver, tantalum, tin, titanium, tungsten, vanadium, zinc, zirconium. Various alloys of copper, iron, nickel maybe used. Also, brass may be used (an alloy of copper, zinc and lead). Various combinations and thicknesses of layered metals may be used. Oxides, nitrides, sulfides, carbides may also be used. Layers of metals and non-metals are also useful.

The invention is further illustrated by means of the following examples.

EXAMPLE 1

A non-woven fabric from BBA Remay of Old Hickory, Tenn. was coated with 1500 Å of copper metal by a vacuum deposition process. The non-woven was made of 0.44 dtex polyester fibers, had a density of 100 gms/$m^2$ and a thickness of .44 mm. The coating chamber was evacuated to a base pressure of $10-^5$ Torr, the copper was melted by resistance heating such that the heating was uniform across the 1.1 meter coating width. The non-woven web then was passed over the vaporizing copper at speeds varying form 55 . 85 meters/minute. Coating uniformity was monitored visually and its thickness measured with an optical transmission device.

Upon completion of the coating run, the material was examined for its aesthetic properties. Because of the thinness of the coating, each fiber was visible, highlighted by the copper coating such as to provide the texture and detail desired in a decorative product. At the same time the copper was displayed so as to reflect light in a manner contributing to the effect. The coating was well adhered to the non-woven fabric.

The material was overcoated with a clear urethane to protect it against degradation from handling and atmospheric effects. This coating does not materially affect the appearance of the metalized non-woven.

EXAMPLE 2

A sample of the metalized non-woven fabric of Example 1, prior to application of the protective top coat, was brushed with a 10–15% aqueous solution of potassium sulfate. This reacted with the copper metal to produce various colors and shades which further enhance the textures provided by the non-woven.

After the desired effect was reached, the material was dried and then overcoated with a clear urethane to protect it against further changes.

EXAMPLE 3

A further sample of the metalized fabric of Example 1 was overcoated with sputtered silver. The sputtering parameters for coating the silver were: 10 kW (power setting) for <10 seconds, using a vacuum of $10^{-6}$ Torr. The silver coating thickness was about 800 Å. The silver coating and the copper used the non-woven fabric structure as a template. The presence of the copper, under the silver, along with various oxides of the copper and gaps in the silver coating provided unusual visual interest and texture to the physical texture of the non-woven. The total metal thickness is about 2300 Å. Both coatings were well adhered to the non-woven backing. If this were done with conventional gilding foils the desired textures would be obscured by the thickness of the foils.

The material was overcoated with FireTect FR-15 varnish, from FireTect, of Canyon Country, Calif. to protect the coatings against degradation and provide required fire ratings for use of this material as a wall covering.

EXAMPLE 4

A non-woven frabric from BBA Remay of Old Hickory, Tenn. was coated with 1500 A of iron metal by an electron beam vapor deposition process. The non-woven was composed of 4 dtex polyester fibers of 203 gm/$m^2$ density and a thickness of 0.81 mm. The coating parameters were such that the coating chamber was evacuated to a value of $10^{-6}$ Torr and the E-beam strength was about 2 kilo amps. The coating was done in a batch process and coating time took less than 10 seconds.

Upon removal from the coating chamber and examination of the material, the non-woven texture was highlighted and emphasized by the iron coating. The coating was well adhered and dispersed among the fibers of the non-woven. The iron was not overcoated and over a period of months began to acquire the desired patina typical of iron surfaces exposed to air.

EXAMPLE 5

A vinylized cotton fabric from GenCorp, Inc. of Fairlawn, Ohio was coated on the vinyl film side with 1000 Åof titanium metal using a cathodic arc sputtering deposition process. The fabric was a woven fabric with vinyl coating. The vinyl coating was smooth to the touch indicating a surface roughness less than 0.051 mm. The material overall was 540 gms/$m^2$ with a thickness of 0.71 mm. The coating parameters were as follows: chamber pressure of $5\times10^{-5}$ Torr, $V^{t}$=600V and the sputtering time was 5 minutes. Upon inspection, the coating was shown to be tightly adhered and brightly metallic. The material was heat embossed to create a surface design by texturing of the surface and its metal coating. The titanium surface was not overcoated.

EXAMPLE 6

A non-woven fabric was obtained from the Stearns Technical Textiles Company of Cincinnati, Ohio as a 50/50 polyester/rayon blend of 43 gms/$m^2$ and a thickness of 0.13 mm. It was sputter coated with aluminum metal in a Balzer® sputtering unit with coating parameters of 10 kW for 25 seconds at a base pressure of $10^{-6}$ Torr. The coating replicated the textured surface while maintaining a metallic appearance. The metal was not overcoated.

EXAMPLE 7

A sample of the material of Example 1 was spattered, sponged and brushed with a 10–15% aqueous solution of sodium sulfide to create a color change which enhanced the decorative texture and color of the non-woven similar to Example 2 but providing a different palette of colors.

EXAMPLE 8

A non-woven fabric from Colbond, Inc. of Enka, N.C. was coated with 1000 Åof Engravers Brass (62.5 Cu-35.75 Zn-1.75 Pb) by a cathodic arc deposition process. The non-woven fabric was made of polyester fibers with a density of 138 gms/$m^2$ and a thickness of 0.51 mm. The coating parameters consisted of: evacuating the coating chamber to $10^{-5}$ Torr and using a power setting of 8 amps for 3 minutes.

Upon removal from the coating system and inspection, the metal was found to be tightly adhered and replicated the fiber of the fabric with a bright metallic coating of a green-gold color. The surface was not overcoated or further treated.

EXAMPLE 9

Various rolls of non-woven fabrics from BBA Remay of Old Hickory, Tenn. were coated with stainless steel, silver, titanium and copper. The fabric used had a density of 203 gms/$m^2$ and a thickness of 0.81 mm. The fibers were crimped and had a dtex of 4.4. The material was coated with 1000 Åof metal in a continuous sputtering process at a width of 1.37 meters and a web speed of 61 m/min.

After the metal coating, the material was coated, on the side opposite the metal, with an acrylic latex coating (to seal the back side and allow optimum adhesion of wall paper adhesive), and on the side with the metal layer with a fluoropolymer overcoat to protect against moisture and atmospheric effects. These coating materials were supplied by Preferred Finishes, Inc. of Blacksburg, S.C. The coatings did not materially affect the appearance of the metal layer and were a total of 0.008 mm in thickness.

EXAMPLE 10

Samples of Example 9 were overocated on the side with the metallic layer using a fluoropolymer coating solution to which was added Universal Tinting Colorants such as Cal-Tint II from HUlls America, Inc. of Piscataway, N.J. Colorants such as Thalo Blue, Venetian Red, Raw Sienna and/or Burnt Umber were added to further enhance the color range of the metal layer. A total of 20 such combinations were created.

What is claimed is:

1. A process for producing a decorative material comprising the steps of:

(a) providing a textured flexible substrate having surface features greater than 0.051 mm above, below, or both above and below, the plane of the surface of said substrate; and wherein said substrate can be folded back on itself and reversed without damage to the physical properties of said substrate;

(b) applying a thin layer of a metal to the surface of said substrate; wherein said layer of metal has a thickness less than about 2500 Angstroms and said layer of metal replicates the surface pattern of said substrate.

2. A process in accordance with claim 1, wherein said substrate comprises a non-woven material.

3. A process in accordance with claim 1, wherein said layer of metal is applied to said surface by means of vacuum deposition.

4. A process in accordance with claim 1, wherein said layer of metal is applied to said surface by means of sputtering.

5. A process in accordance with claim 1, wherein said layer of metal is applied to said surface by means of electron beam vapor deposition.

6. A process in accordance with claim 1, wherein said metal comprises copper, and further comprising the step of brushing said layer of metal with an aqueous solution of potassium sulfate.

7. A process in accordance with claim 1, further comprising the step of applying a thin layer of a second metal over said layer of metal, wherein the combined thickness of said metals is less than about 2500 angstroms.

8. A process in accordance with claim 7, wherein said second metal comprises silver.

9. A process in accordance with claim 1, wherein said metal is selected from the group consisting of copper, silver, iron, aluminum, silicon, chromium, cobalt, gold, nickel, tantalum, tungsten, vanadium, zinc, zirconium, tin, titanium, and manganese.

10. A process in accordance with claim 1, wherein said substrate comprises plastic.

11. A process in accordance with claim 1, wherein said substrate comprises paper.

12. A process in accordance with claim 1, wherein said substrate comprises fibers.

13. A process in accordance with claim 1, wherein said substrate comprises a woven fabric.

14. A process in accordance with claim 1, wherein said metal comprises iron.

15. A process in accordance with claim 14, wherein said iron is applied by means of electron beam vapor deposition.

16. A process in accordance with claim 1, wherein said substrate has been treated to provide a surface roughness greater than 0.051 mm.

17. A process for producing a decorative material comprising the steps of:

(a) providing a flexible substrate which can be folded back on itself and reversed without damage to the physical properties of said substrate;

(b) applying a thin layer of a metal to the surface of said substrate; wherein said layer of metal has a thickness less than about 2500 Angstroms; and (c) modifying said substrate to produce surface features thereon of 0.051 mm. or greater.

* * * * *